United States Patent [19]

Mottet

[11] Patent Number: 4,596,414

[45] Date of Patent: Jun. 24, 1986

[54] DEVICE FOR COLLECTING BALLS OR OTHER OBJECTS CAPABLE OF ROLLING

[76] Inventor: Willy Mottet, Wiesenstrasse, 9, 2562 - Port, Switzerland

[21] Appl. No.: 713,125

[22] Filed: Mar. 15, 1985

[30] Foreign Application Priority Data

Mar. 23, 1984 [FR] France ..... 84 04963

[51] Int. Cl.[4] ..... A63B 47/02

[52] U.S. Cl. ..... 294/19.2; 56/328 R; 294/50.8; 414/467

[58] Field of Search ..... 294/1.4, 2, 19.1, 19.2, 294/22, 50.5–50.9, 51, 53.5, 55, 57, 59, 68.23, 115; 15/104.8, 257.6, 257.7; 56/328 R, 400.11–400.15; 171/63; 280/47.26, 47.34; 414/434, 450, 467, 490

[56] References Cited

U.S. PATENT DOCUMENTS

| | | | |
|---|---|---|---|
| 559,384 | 5/1896 | Hunt | 294/68.23 |
| 1,187,316 | 6/1916 | Higby | 294/50.8 |
| 2,120,326 | 6/1938 | Doerschlen | 294/68.23 X |
| 2,215,592 | 9/1940 | Nelson | 56/400.13 |
| 2,409,778 | 10/1946 | McCaffrey | 294/68.23 X |
| 2,817,405 | 12/1957 | Pearson | 56/328 R X |
| 3,593,868 | 7/1971 | Folz | 56/328 R X |

FOREIGN PATENT DOCUMENTS

| | | | |
|---|---|---|---|
| 539348 | 9/1941 | United Kingdom | 171/63 |

*Primary Examiner*—Johnny D. Cherry
*Attorney, Agent, or Firm*—Michael F. Petock

[57] ABSTRACT

The device comprises two shells equipped with casters allowing it to move. The shells can pivot on vertical hinges as a result of the movement of a grip sliding along a handle connected to the hinges. The grip is connected to the shells by arms attached through omni-directional joints to the grip and to each arm. Movement of the grip in one direction causes the shells to open, and movement in the other direction causes them to close to form a box. The device can be used to collect tennis balls without excessive fatigue.

6 Claims, 3 Drawing Figures

DEVICE FOR COLLECTING BALLS OR OTHER OBJECTS CAPABLE OF ROLLING

BACKGROUND OF THE INVENTION

The present invention concerns a device for collecting, from a surface, objects capable of rolling. Such objects, spherical or spheroidal in shape or more generally of approximately rounded shape so that they are capable of rolling, may be, for example, balls or fruits of relatively firm consistency.

The invention will be discussed with particular reference to the collection of tennis balls, an application for which it seems particularly suited, with the understanding that this example is not limiting and that the invention can just as well be applied to the collection of a number of objects, insofar as permitted by their rounded form and by the configuration of the surface on which they are resting.

It is well known that tennis teachers are in the habit of working with their pupils using one or more baskets containing a large number of balls, in order to avoid the loss of time and the fatigue caused by individually collecting each ball after use so that it can immediately be re-used. When the basket or baskets is or are empty, the playing area is littered with balls, which must then be collected and put back in the baskets. This activity represents not only a significant loss of time for the pupil and/or teacher, but rapidly becomes painful for the back.

The invention is designed to eliminate these inconveniences by proposing a device for rapid collection which prevents any excessive back fatigue.

SUMMARY OF THE INVENTION

In accordance with the present invention, a device is provided for collecting objects capable of rolling on a surface, such as tennis balls, fruit or the like. The present invention comprises two shells equipped with casters which allow them to move over the surface on which the balls may be laying. The shells are capable of pivoting on vertical hinges as a result of the movement of a grip which slides on a handle connected to the hinges. The grip is connected to the shells through arms which are articulated to the grip and to each shell. The movement of the grip in one direction causes the shells to open and the movement of the grip in the other direction causes them to close forming a box.

The present invention provides a relatively inexpensive and efficient means of collecting balls or the like from a surface without having to bend over to pick them up. Once the balls are collected, they may be moved in the closed container to another location.

BRIEF DESCRIPTION OF THE DRAWINGS

The technical characteristics of the invention, which are the subject of the claims, and certain advantages thereof, are discussed in the following description, explained with reference to the drawings, in which:

DETAILED DESCRIPTION OF THE PREFERRED EMBODIMENTS

Figure 2:
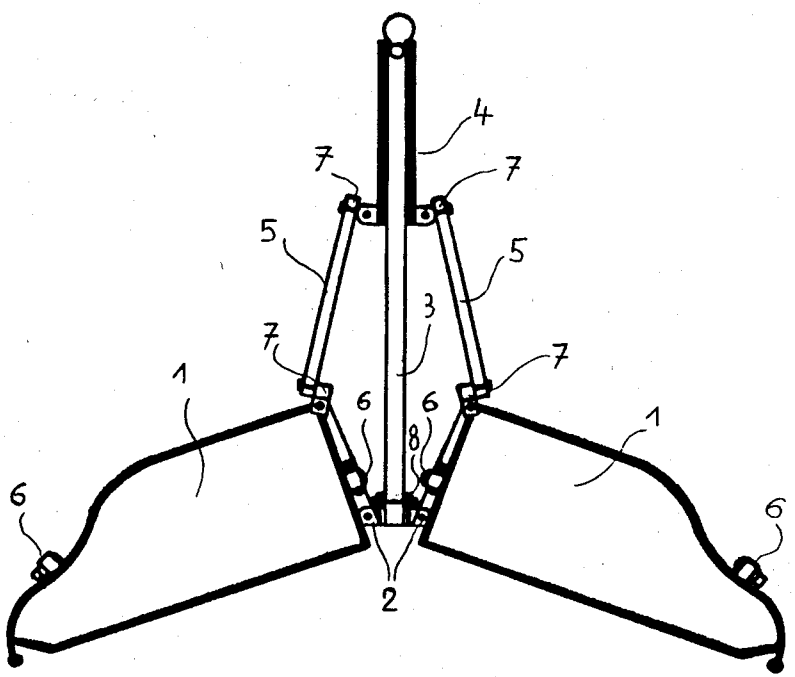
FIG. 2 is a schematic representation of the same device, but in the open position.
Figure 1:
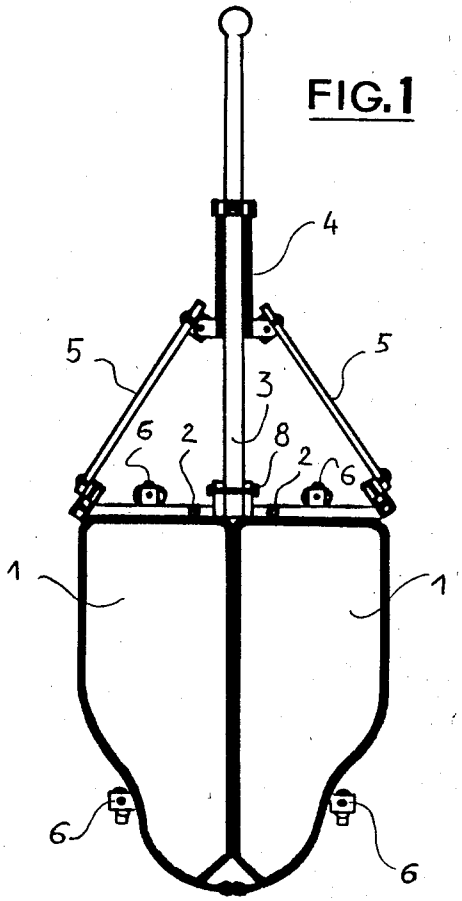
FIG. 1 is a schematic representation of a device according to the invention, seen from above in the closed position.
Figure 3:
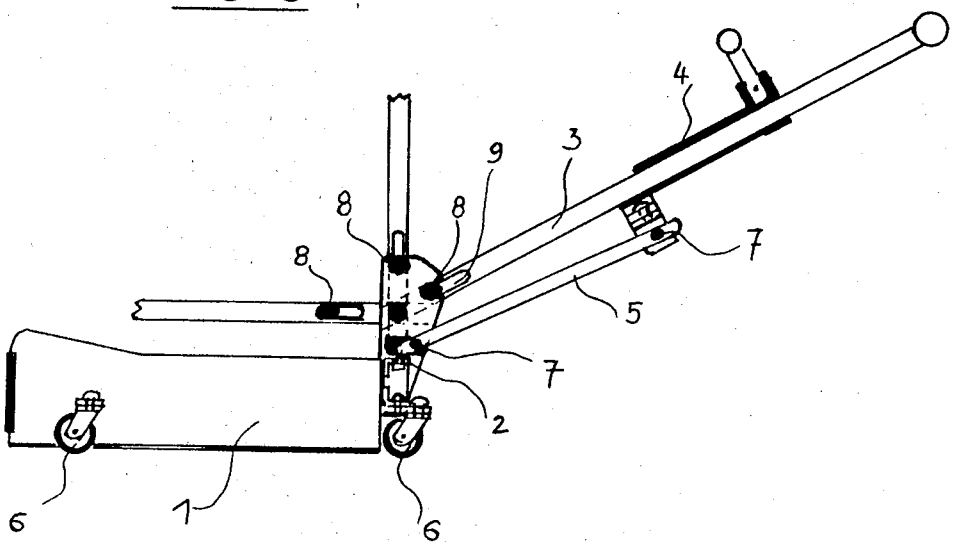
FIG. 3 is a side view of the same device illustrating various positions of its maneuvering handle.

The ball-collector shown comprises a flat-bottomed box with approximately vertical lateral walls, open at the top, consisting of two separate shells 1, preferably symmetrical, which meet along their inner edges, when the device is in the closed position (FIG. 1), to form the box. Each shell 1 is equipped with a vertical-axis hinge 2, located in the vicinity of the center plane of the device and connected to a handle 3. Handle 3 is connected at an angle to the bottom of shells 1 so that it slopes upwardly away from the surface on which castors 6 ride as shown in FIG. 3. A grip 4 slides along the handle 3, and is connected on either side to an arm 5, hinged at one end to this grip 4 and at the other end, through the joints 7, to a point in the vicinity of the lateral edge of the posterior vertical wall of the corresponding shell 1. Thus, movement of grip 4 from the position illustrated in FIG. 1 towards the position illustrated in FIG. 2 causes the shells 1 to pivot about the vertical hinges 2, causing the box to open.

In addition, the shells 1 are equipped externally with casters 6, preferably movable in the conventional manner and making it possible, by means of the handle 3, to move the open or closed box in any direction over the surface in question, while maintaining the box very close to this surface. The flat bottom of the box moves substantially parallel to the surface as may be seen in FIG. 3.

Preferably, the joints 7 of the arms 5 will be of the known omnidirectional type, and the handle 3 will be connected to the fixed part of the vertical hinges 2 through an articulation device with a lockable horizontal pin, which in the unlocked position can move within the longitudinal slots 9 present in the handle 3 (FIG. 3). The handle 3 can therefore assume various positions between an operating position in the entirely deployed state, where the handle 3 is inclined (right-hand side of FIG. 3), and an entirely folded position which limits its bulk, for example for transport or storage, as shown in FIG. 3. A vertical position, also sketched in FIG. 3, also makes it possible to use the handle 3 of the device, when not in use, as a support for a video camera, use of which is widespread in the teaching of tennis, or additionally as a support for a ball basket.

The operation of collecting the balls is extremely simple. Once the handle 3 is placed in the unfolded position, the grip 4 is pulled along the handle 3 and the two shells 1 move away from one another, opening the box. The device is pushed towards the balls, which roll into the far end of the shells 1 where they accumulate. The box is then closed again by pushing the grip 4 until the shells 1 close completely.

I claim:

1. A device for collecting objects capable of rolling on a surface, characterized by the fact that it comprises two shells having a substantially flat bottom, said shells being equipped with casters which allow the bottom of said shells to move over said surface substantially parallel therewith, these shells being capable of pivoting on substantially vertical hinges as a result of the movement of a grip which slides on a handle, said handle being connected to the hinges at an angle to the bottom of said shells so that it slopes upwardly away from said surface, said grip being connected to the shells through arms which are themselves articulated to the grip and to each shell, such that movement of the grip in one direction causes the shells to open, and movement in the other direction causes them to close forming a box.

2. A device in accordance with claim 1, wherein the joints between the arms and the grip and between the arms and shells are omnidirectional.

3. A device in accordance with claim 2 wherein the handle is connected to the hinges by means of a horizontal pin joint.

4. A device in accordance with claim 3 wherein the horizontal pin joint can be locked in a position to hold said handle in a substantially vertical position between two extreme positions.

5. A device according to claim 2 for the collection of tennis balls, wherein the handle may be locked in the vertical position to serve as a support for a video camera.

6. A device according to claim 2 for the collection of tennis balls, wherein the handle may be locked in a vertical position to serve as a support for a ball basket.

* * * * *